United States Patent [19]

Trimble

[11] 4,056,220

[45] Nov. 1, 1977

[54] PORTABLE BOAT-CARRIED RACK FOR WATER SKIS AND TOW ROPES

[76] Inventor: Steven M. Trimble, 1302 Banbury Road, Apt. H, Kalamazoo, Mich. 49001

[21] Appl. No.: 600,383

[22] Filed: July 30, 1975

[51] Int. Cl.[2] ..... B60R 9/08

[52] U.S. Cl. ..... 224/42.45 R; 9/1.7; 211/60 SK

[58] Field of Search ..... 224/29 R, 42.1 F, 42.32, 224/42.33, 42.38, 42.39, 42.4, 42.42 R, 42.45 R, 42.46 R; 280/179 R, 179 A, 179 B, 11.37 R, 11.37 A, 11.37 K; 211/60 SK, 13, 60 R, 60 A, 60 G; 114/235 WS; 9/1 D; 40/124, 124.4, 124.2

[56] References Cited

U.S. PATENT DOCUMENTS

| | | | |
|---|---|---|---|
| 2,434,387 | 1/1948 | Brandt | 224/42.1 F |
| 2,782,973 | 2/1957 | Lang | 224/42.1 F |
| 2,919,032 | 12/1959 | Sinawski | 211/60 SK |
| 2,988,253 | 6/1961 | Menghi | 224/42.1 F |
| 2,999,693 | 12/1961 | Thorson | 211/13 X |
| 3,155,238 | 11/1964 | Bennett | 211/60 SK |
| 3,348,747 | 10/1967 | Vuarchex | 224/42.1 F |
| 3,368,785 | 2/1968 | Weiler | 280/179 R |
| 3,695,495 | 10/1972 | Parsons | 224/29 R |
| 3,776,437 | 12/1973 | Carney | 224/42.45 R |
| 3,811,143 | 5/1974 | Page | 114/235 WS X |
| D. 157,082 | 1/1950 | Patton | 40/124 X |

*Primary Examiner*—Robert J. Spar
*Assistant Examiner*—Winston H. Douglas
*Attorney, Agent, or Firm*—Scrivener, Parker, Scrivener and Clarke

[57] ABSTRACT

A portable rack for water skis and tow ropes is provided with means by which it may be releasably mounted on the transom of a boat and comprises spaced connected end members each of which has narrow slots extending inwardly from its edge, the slots in opposite end members being aligned to snugly receive water skis, the end members being provided with rods which are slidable through the end members to permit the rack to be accommodated to boats of different sizes, and quick release means of adjustable length are provided on each end member for releasably but firmly connecting the rack to the boat, and a strap is releasably trained over the edge of each end member to hold the skis in place in the slots. Spaced spools are provided over and between which tow ropes may be coiled for storage.

1 Claim, 6 Drawing Figures

PORTABLE BOAT-CARRIED RACK FOR WATER SKIS AND TOW ROPES

BACKGROUND OF THE INVENTION

Water-skiing is a very popular sport, and not all of those who enjoy it can afford a boat on which their skis and tow ropes are permanently carried. The invention therefore provides a portable rack for skis and tow ropes which may be carried to a boat, adjusted to the size of the boat, and quickly and releaseably mounted thereon and connected thereto and removed therefrom.

SUMMARY OF THE INVENTION

The rack for skis and tow ropes provided by the invention is a unitary portable structure having connected spaced end members having aligned slots to receive skis, and rods which slidably extend through each end member to permit the rack to be supported on boats of various sizes, and also having means whereby the rack may be connected to boats of various sizes. Straps are provided on each end member for holding the skis within the slots, and spaced spools are provided on the rack which form an elongated means about which tow ropes may be coiled for storage.

DESCRIPTION OF THE INVENTION

Figure 1:
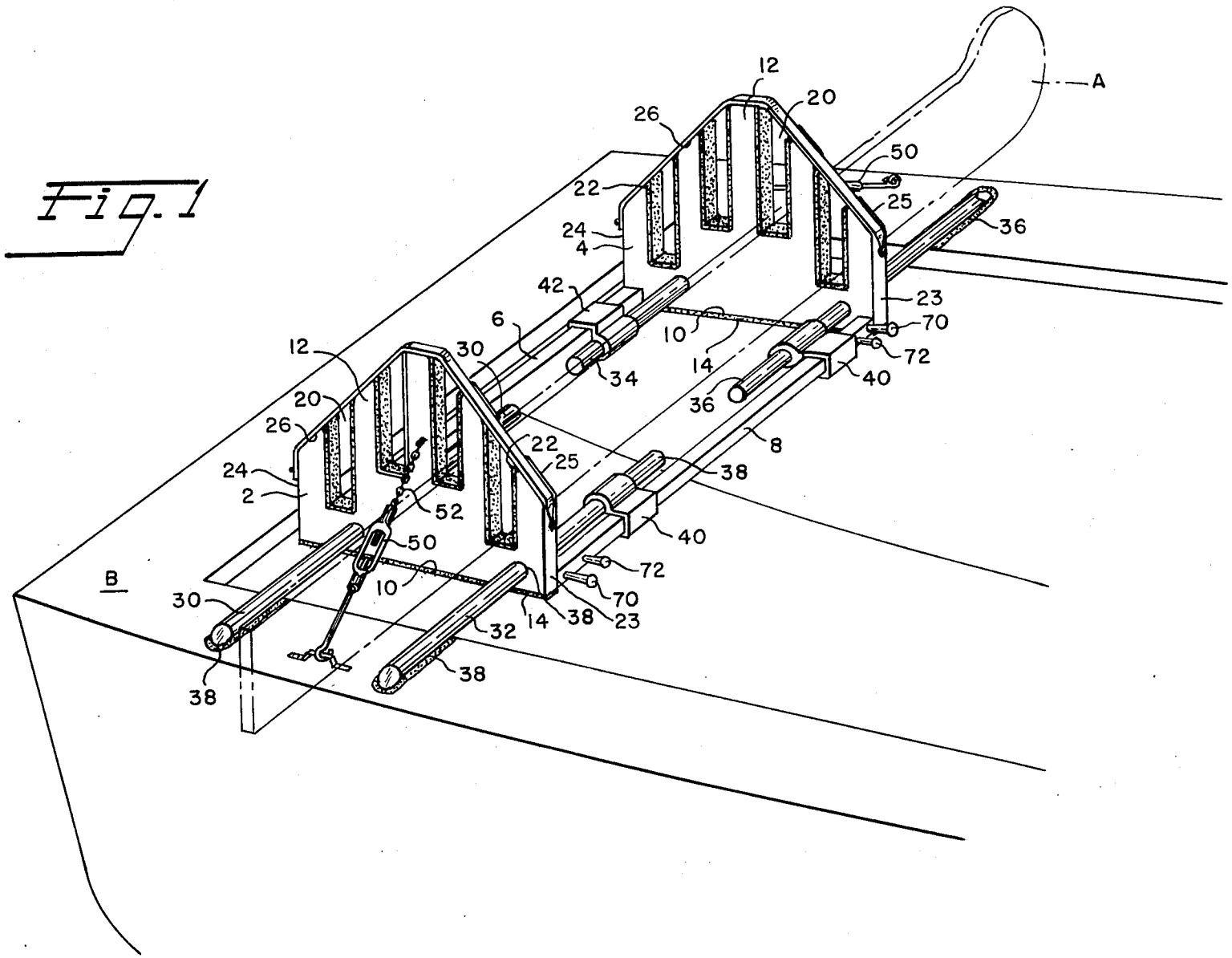
FIG. 1 is a perspective view of the rack provided by the invention, mounted on the transom of the boat.
Figure 2:
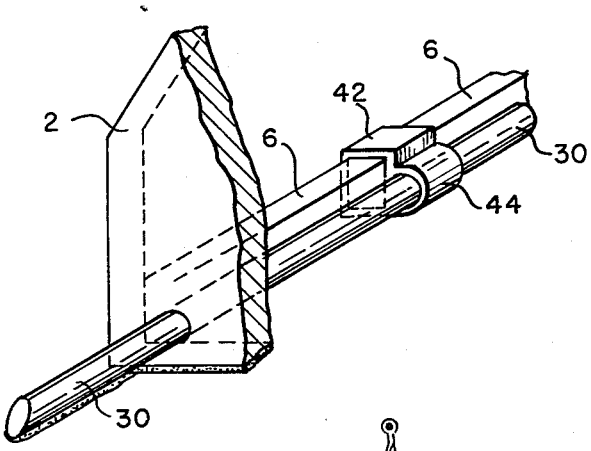
FIG. 2 is partial perspective view of the adjustable supporting means for the rack.

The rack for water skis and tow ropes provided by the invention comprises a portable structure having spaced end members 2, 4 which are connected by elongated members 6, 8 to form a unitary structure of a length somewhat shorter than the water skis it is adapted and intended to hold. The end members are planar and parallel and each has a flat lower edge 10 and an edge 12 above the flat lower edge which, in the disclosed embodiment, has the shape of an equilateral triangle. The two end members are preferably of the same size and shape, whereby their edges 10, 12 are aligned. The bottom surface of each flat lower edge 10 of each end member is covered with a layer 14 of soft material which protects the finish of the boat when the rack rests directly on the deck, transom or other part of the boat when the extension supports are not required.

A plurality of slots 20 are formed in each end member and extend inwardly from the outer edge 12 thereof, each slot being aligned with a slot in the other end member. The slots are of sufficient depth to receive all or a major part of the width of a water ski A and are of sufficient width to firmly and snugly receive one or more water skis depending on the design of the rack and the number of skis it is designed to hold. The preferred embodiment of the invention disclosed in the drawings has four slots in each end member and is designed to hold two pairs of water skis. Each slot is lined with a layer 22 of a soft material which protects the finish of the ski and prevents sliding movement of the ski in the slot.

Means are provided by the invention for supporting skis in stepped relation (i.e. in parallel planes with one ski above the other) so that skis with boots attached to them may be stored in a smaller and more compact space. In accordance with this aspect of the invention each of the end members 2,4 has a substantially vertical front edge 23, a substantially vertical rear edge 24 and front and rear upper edges 25, 26. These upper edges are inclined to the vertical and converge upwardly toward each other, meeting in an apex approximately midway between the front and rear edges of the end member. The slots 20 which are formed in each end member extend downwardly into the end member from one or the other of the inclined upper edges 25, 26 and are of substantially the same depth, by reason of which their bottoms are stepped upwardly from each other from the front and rear edges toward the center of the end member. Thus, when skis are placed in the slots they rise in stepped relation, one above the other, thus permitting skis with boots attached to be stored without having to provide space to accomodate the boots.

Means are provided by the invention for supporting this portable rack on the surface of the transom B of a boat to which the rack may be carried, regardless of the size or beam of the boat. Such means comprise four rod-like extensible support members 30, 32, 34, 36 which are preferably circular in cross section and each of which slidably but snugly extends through an opening 38 in one of the end members and,within the rack, i.e. between the end members 2, 4 is positioned in side-by-side parallel association with one of the elongated members 6, 8 which connect the end members. Each of these support members is connected to its associated connecting members 6 or 8 for relative sliding movement by means of an integrally formed member 40 having a part 42 of rectangular cross section which surrounds and is connected to the connecting member 6 or 8, and a second part 44 which is of circular cross section and slidably receives one of the extensible support members. The support members 30, 32, 34, 36 are normally positioned within the rack between the end members and may be moved outwardly from the end members to any desired length so that the ends of the support members rest on the gunwales of the boat, as shown in FIG. 1. A layer 38 of soft non-skid material is attached to and covers the underside of each of the support members at and adjacent to the end thereof, and prevents sliding movement of the support members on the boat parts on which they rest and also protects the finish of such parts. If desired, suction cups may be substituted for the described layers of soft material.

Figure 5:
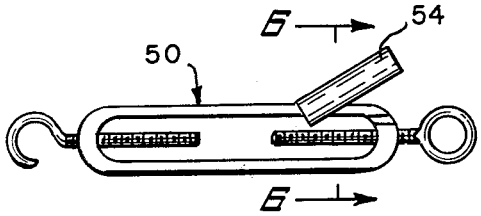
FIG. 5 is an elevational view of the locking turnbuckle.
Figure 6:
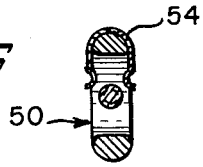
FIG. 6 is a sectional view taken on line 6—6 of FIG. 5.

Means are provided by the invention for releaseably connecting each end of the rack to a boat after it has been supported thereon, and in the preferred embodiment disclosed in the drawings, the means at each end comprises a locking turnbuckle 50 and a connected length of chain 52 which together form means for gross and fine adjustment of length. The length of chain is provided at one end with a hook for releaseable connection to the outer surface of an end member and the outer or free end of the turnbuckle is formed with means for releaseable connection to a part of the boat, all as shown in FIG. 1 of the drawings. The locking means 54 for the turnbuckle is shown in FIG.5 in release position and in FIG. 6 in locking position. It will be apparent that each buckle and chain connecting device may be adjusted in length to permit attachment to boats of various sizes or to parts of a boat which are differently spaced.

Figure 3:
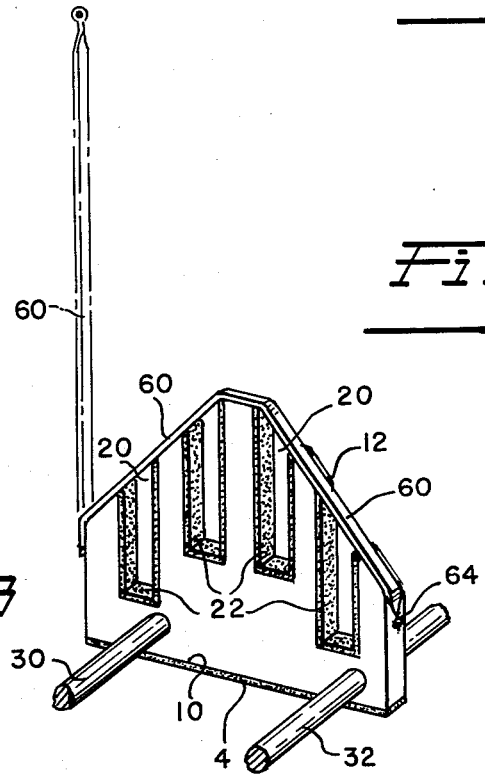
FIG. 3 is an enlarged perspective view of the strap provided for holding skis in the rack.

Means are also provided by the invention for firmly but releaseably holding the skis within their slots in order to prevent accidental displacement therefrom on pitching or rolling of the boat. Such means are particularly disclosed in FIG. 3 and are associated with, and form part of, each end member of the rack, and each comprises an elongated flexible strap 60 which is connected at is one end to its associated end member 2 or 4 at 62 adjacent one side of the end member, and from that connection extends across the edge surface 12 of the end member and across the skis within the slots therein, and at its free end is provided with a latch, buckle or other fastening means which co-operates with fastening means on the other edge of the end member, such co-operating fastening means being shown at 64. It will be apparent that the straps may be released to permit the skis to be placed within the slots, after which the straps are trained over the edges of their respective end members and the skis, and their free ends fastened.

Figure 4:
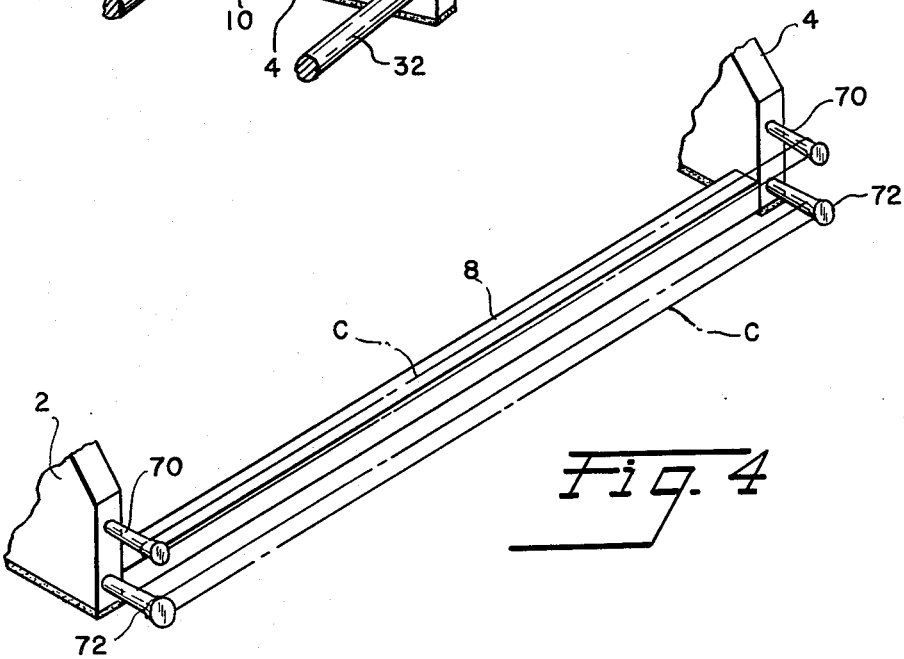
FIG. 4 is an enlarged perspective view of the rack for tow ropes.

Means, which are particularly disclosed in FIG. 4, are provided by the invention for storing tow ropes, and such means are preferably provided on both the front and the back of the rack. In each case this means comprises one or more pairs of spool shaped members 70, 72, the spools of each pair being preferably connected to and extending outwardly from the front or back, of the end members 2, 4, as shown in FIG. 4, or from the connecting members 6, 8 as shown in FIG. 1, and one or more tow ropes C may be stored by being trained about each pair of spool shaped members.

I claim:

1. A rack for water skis adapted to be mounted on a boat so that it extends athwart the boat, the rack comprising two transversely spaced, paralleled planar end members having substantially the same size and shape, elongated members connecting the end members to form a unitary structure of fixed length, each end member having a horizontal bottom surface, substantially vertically extending front and rear lower surfaces and inclined front and rear upper surfaces which converge upwardly to an apex substantially at the center of the end member, a plurality of open ended vertical slots formed in each end member and extending downwardly from both of the front and rear inclined upper surfaces thereof, the slots being substantially the same vertical dimension, each slot in one of said end members being transversely aligned with a corresponding slot in the other end member whereby a ski placed on its side edge in any pair of aligned slots will be in relatively, vertically stepped position and relation with respect to skis placed in any other pair of aligned slots in the same front or rear inclined upper surface of the rack, all of the slots being of such a size and configuration that each pair of aligned slots will receive and retain at least one ski positioned on its side edge, each end member having at least two openings extending therethrough adjacent a lower part thereof in a direction normal to the plane of the end member, and an elongated rod-like supporting member positioned in each opening for sliding movement through the opening whereby the end portions of the supporting members, not positioned within the rack between the end members, provide means external to each end member for supporting the rack on corresponding boat parts of various transverse spacings.

* * * * *